US005440315A

United States Patent [19]

Wright et al.

[11] Patent Number: 5,440,315

[45] Date of Patent: Aug. 8, 1995

[54] ANTENNA APPARATUS FOR CAPACITIVELY COUPLING AN ANTENNA GROUND PLANE TO A MOVEABLE ANTENNA

[75] Inventors: George C. Wright, Duvall; David W. Gilpin, Everett; Stanley W. Jones, desceased, late of Lopez, all of Wash., by Ivaly J.; Hoedemaker, administratirix

[73] Assignee: Intermec Corporation, Everett, Wash.

[21] Appl. No.: 185,717

[22] Filed: Jan. 24, 1994

[51] Int. Cl.[6] ..... H01Q 1/24

[52] U.S. Cl. ..... 343/702; 343/847; 343/882; 343/888; 343/906

[58] Field of Search ..... 343/713, 715, 702, 714, 343/878, 830, 880, 847, 882, 848, 888, 791, 889, 900, 906, 792; H01Q 1/24, 1/12; 439/164, 916; 455/347, 351; 174/65 R, 152 A, 153 A

[56] References Cited

U.S. PATENT DOCUMENTS

| | | | |
|---|---|---|---|
| 2,204,861 | 6/1940 | Knapp | 343/714 |
| 2,895,752 | 7/1959 | Bassie | 343/714 |
| 4,791,426 | 12/1988 | Lindenmeier et al. . | |
| 4,794,319 | 12/1988 | Shimazaki . | |
| 4,825,217 | 4/1989 | Choi . | |
| 4,916,456 | 4/1990 | Shyu . | |
| 4,931,806 | 6/1990 | Wunderlich . | |
| 5,271,684 | 12/1993 | Phillips | 343/882 X |

FOREIGN PATENT DOCUMENTS

| | | | |
|---|---|---|---|
| 0306703 | 12/1990 | Japan | H01R 1/240 |

*Primary Examiner*—Donald Hajec
*Assistant Examiner*—Tho G. Phan
*Attorney, Agent, or Firm*—Seed and Berry

[57] ABSTRACT

An antenna apparatus for a hand-held symbology reader device having a housing and an elongated one-quarter wavelength antenna. A rotatable coupling member has an L-shaped conductor fixedly and electrically coupled to the antenna by a first end thereof. A second end of the L-shaped conductor is rotatably received by the housing. A ground plane of an electrically conductive material, having a plastic film coated thereon, is positioned within the housing. A washer of an electrically conductive material is electrically coupled to the second end of the L-shaped conductor, and is positioned in face-to-face juxtaposition with a portion of the ground plane. The washer and the portion of the ground plane form a parallel plate capacitor, with the plastic film forming a dielectric therebetween to capacitively couple the ground plane to the antenna. The antenna may be repeatedly rotated from an upright, transmitting/receiving position to a stowed position, without damage to the device or electrical disconnection between the antenna and the ground plane.

21 Claims, 4 Drawing Sheets

ANTENNA APPARATUS FOR CAPACITIVELY COUPLING AN ANTENNA GROUND PLANE TO A MOVEABLE ANTENNA

TECHNICAL FIELD

The present invention relates to antennas for hand-held electronic devices.

BACKGROUND OF THE INVENTION

If the size of a wireless electronic transmitting and/or receiving device ("radio device") is not a concern, then the size of an antenna for the device is irrelevant. However, when size is a consideration, as it is with most radio devices and certainly with hand-held devices, the size of the antenna must be reduced. Generally, the length of an antenna is related to the frequency at which data is communicated. To reduce the size of the antenna, the electronic device may be designed to communicate at higher frequencies (and thus shorter wavelengths). An antenna length of at least one-half the wavelength of the communication frequency is generally used. A one-half wavelength antenna uses two elongated conductors substantially coaxially aligned where each conductor is one-quarter wavelength long. For a radio transmitting device, one conductor transmits the signal (the radiating conductor) while the other conductor acts as a ground (the ground conductor).

To further reduce the length of the antenna, the electronic device may use a ground plane. A ground plane acts as a "mirror" portion of the antenna, effectively doubling the length of an elongated conductor with which it is coupled. Thus, a single elongated one-quarter wavelength conductor, together with a ground plane acting as another one-quarter wavelength conductor, combine to act as a one-half wavelength antenna.

If the radio device is to be portable, it generally must be environmentally secure. Many portable radio devices, such as cellular telephones, have antennas fixed to the exterior of a vehicle in which they are located. The antenna may be mounted to the body of the vehicle; however, holes must be made in the body to (1) mount the antenna and (2) pass wires through to interconnect the antenna and the telephone. These holes compromise the environmental integrity of the vehicle and/or telephone.

To avoid making holes into the vehicle to mount the antenna, several antenna systems capacitively couple the antenna to an interior module within the vehicle which in turn is electrically coupled to the telephone. Most cellular telephones used today operate at very high frequencies. At such high frequencies, a capacitor acts as a short circuit. Therefore, these antennas use the dielectric properties of the glass to which they are affixed to electrically (capacitively) couple to the interior module and thus to the cellular telephone without the need to drill holes through the glass.

Such cellular telephone antennas generally cannot use a ground plane, because both the radiating and ground conductors are capacitively coupled to the interior module. With vehicle mounted antennae, however, size is not necessarily a design constraint, and at the very high cellular telephone frequencies, a one-half wavelength antenna is relatively short.

Most antennas are generally fixed. If the antenna is required to be repeatedly rotated or moved, additional problems arise, particularly those with regard to environmental integrity. Water or other contaminants could penetrate into the device at the point of rotation. If the antenna uses a ground plane, the ground plane must be electrically coupled to the antenna by a mechanical connector. If the antenna is to be rotated, the mechanical means will suffer from wear as the two conductive surfaces rub against each other. Over time, this wear will damage the antenna and/or the mechanical connector, and result in failure of the electrical or mechanical connection therebetween. More reliable rotatable electrical connectors are available; however, these electrical connectors are expensive.

Overall, the inventors are unaware of any inexpensive antenna system which allows the use of a shortened quarter wavelength antenna, rotatable or movable with respect to the electronic device, and which provides environmental integrity between the antenna and the electronic device to which it is coupled.

SUMMARY OF THE INVENTION

According to principles of the present invention, an antenna assembly for a hand-held device having a housing includes an elongated, one-quarter wavelength antenna having first and second antenna conductors. A rotatable coupling member has a first end portion rigidly retaining the elongated antenna and has a second end rotatably received by the housing. The second end extends through a hole in the housing. The coupling member and the antenna are rotatable as a unit between a first position where the antenna is in an approximately upright position with respect to the housing, and a second position where the antenna is in a non-upright position. The coupling member has first and second coupling conductors extending between the first to the second end portions, and the first and second coupling conductors are electrically coupled to the first and second antenna conductors at the first end portion, respectively.

An electrically conductive ground plane is positioned within the housing. The ground plane is at least partially covered on at least one side thereof with a non-conductive material. An electrically conductive plate is positioned within the housing and is electrically coupled to the second coupling conductor at the second end portion. The plate has a first face thereof positioned approximately parallel to at least a portion of the ground plane covered with the non-conductive material, the plate being capacitively coupled to the ground plane.

Preferably, the first and second antenna conductors are coaxial, the first and second coupling conductors are coaxial, the coupling member is approximately L-shaped, the second end portion extends through an aperture in the portion of the ground plane, and the plate is a washer coaxially received about the second end portion. The first face of the washer rotates against the portion of the ground plane covered with the non-conductive material as the antenna is rotated between the upright and the non-upright positions.

A spring is coaxially positioned with the second end portion of the coupling member, adjacent to the second face of the plate. A locking member is and fixedly retains the second end portion of the coupling member within the housing. The coupling member includes an elastomeric member coveting the first and second conductors, between the first and second end portions. The elastomeric coveting has an engagement face from which the second end portion protrudes. The housing includes at least one seal ting at an exterior surface of the housing and extending about the hole. The engagement face is received against and rotatable relative to the seal ting to substantially form an environmental seal therebetween as the antenna is rotated between the upright and the non-upright positions.

The present invention solves problems inherent in the prior art by providing a one-quarter wavelength antenna capacitively coupled to a ground plane, rotatable with respect to the housing, which provides environmental integrity between the antenna and the interior of the housing. Other features and advantages of the present invention will become apparent from studying the following detailed description of the presently preferred embodiment, together with the following drawings.

DETAILED DESCRIPTION OF THE PRESENTLY PREFERRED EMBODIMENT

Figure 1:
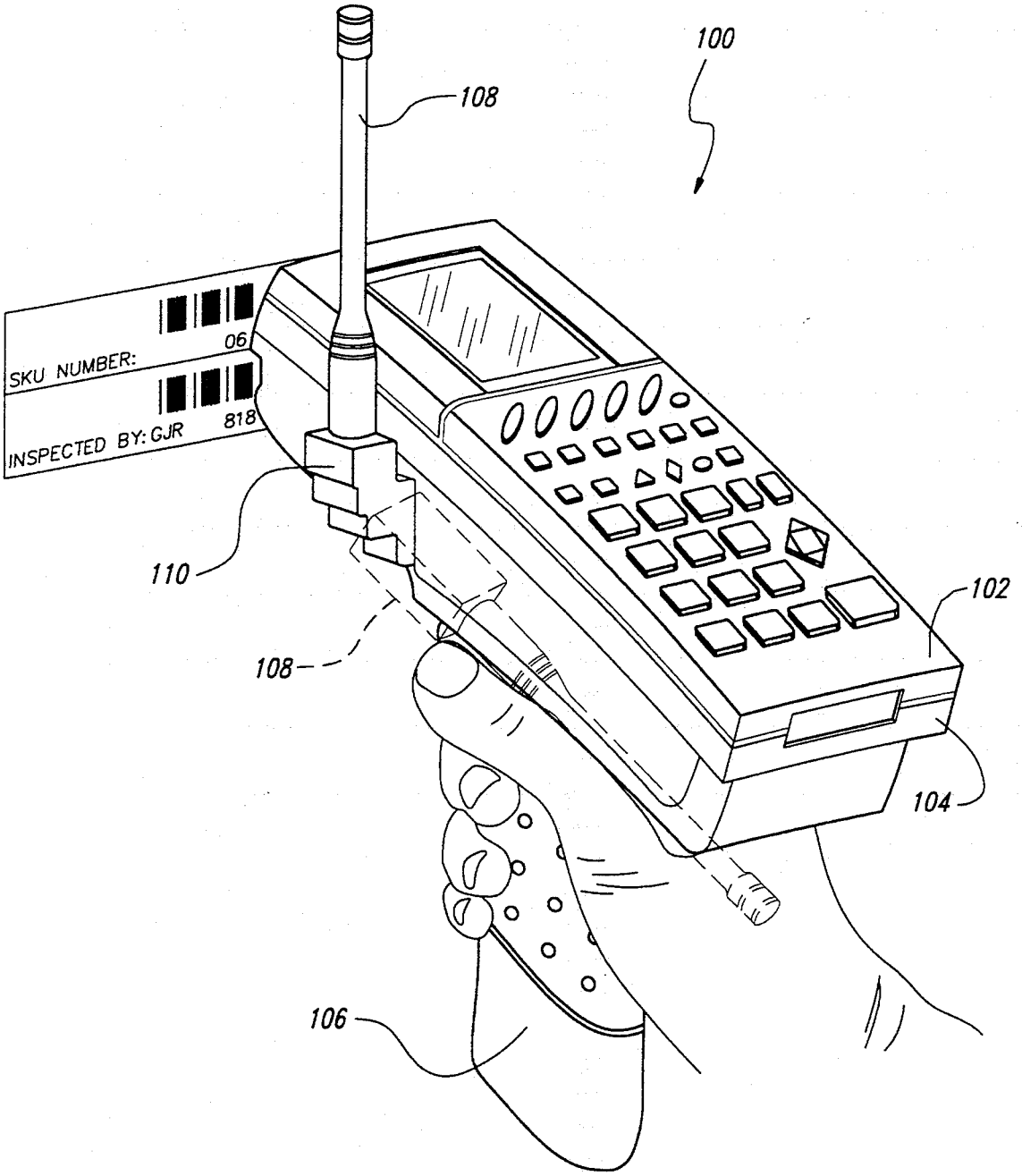
FIG. 1 is an isometric view of a hand-held electronic device using an antenna assembly of the present system.
Figure 2:
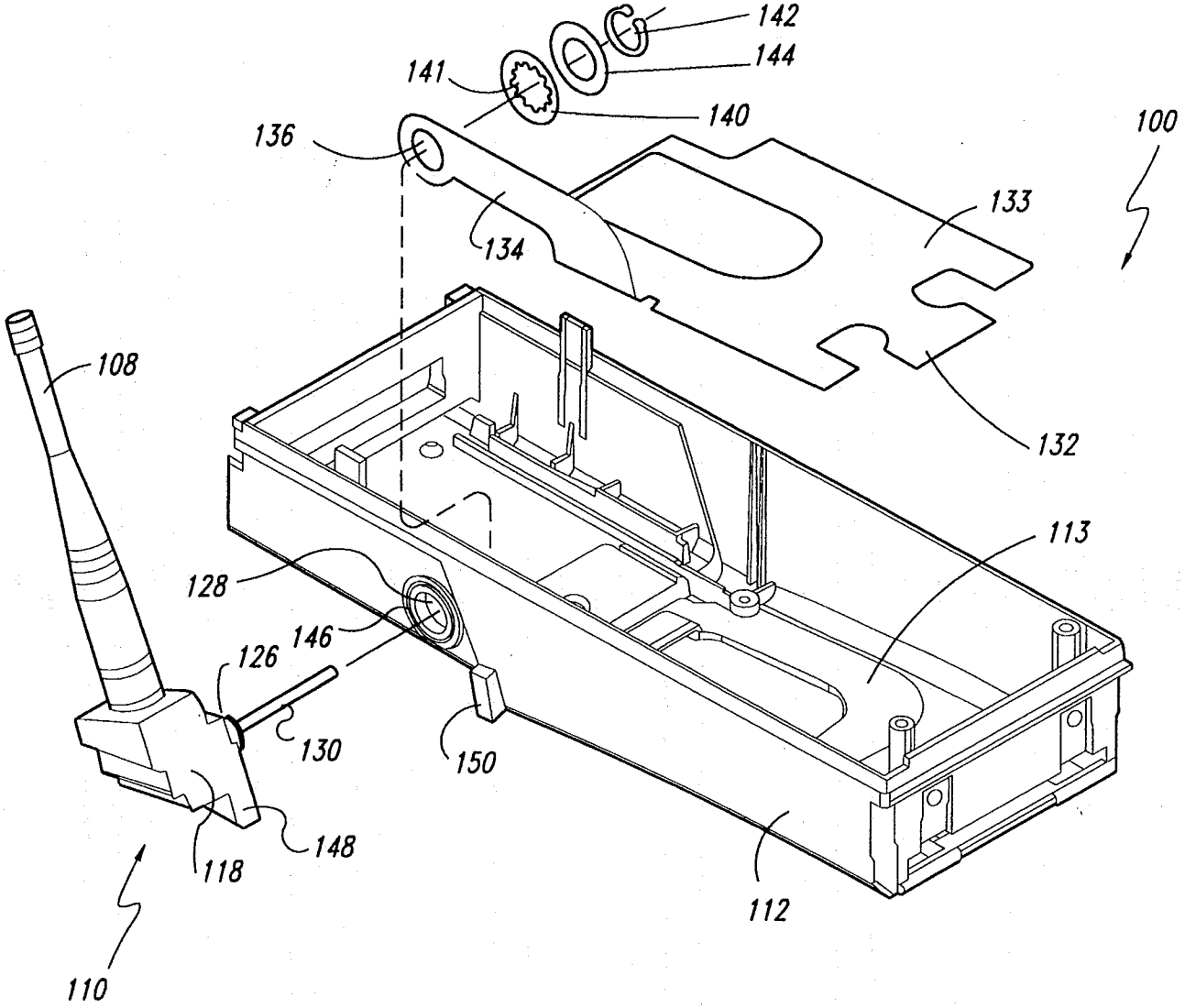
FIG. 2 is an enlarged scale, fragmentary, exploded isometric left side view of the antenna assembly of FIG. 1.

A portable, hand-held electronic device 100, such as a battery powered bar code reading or scanning device, has an upper housing 102, a lower housing 104 and a handle 106 extending downward from the lower housing, as shown in FIG. 1. The upper and lower housings 102 and 104 are preferably fabricated of a rigid plastic and together form a housing. The lower housing 104 has an elongated left wall 112, an elongated right wall 11, a bottom wall 113, and top, front and rear walls, as shown in FIG. 2. An elongated antenna 108 extending from a coupling member 110, is rotatably mounted to the left wall 112 of the lower housing 104.

The device 100 includes communications circuitry (not shown) for transmitting and/or receiving data communication to which the antenna 108 is electrically coupled. The device 100 preferably communicates at high frequencies, such as in the range of 900 to 930 megahertz. At such high frequencies, a short antenna, relative to the size of the device 100, can be used. Moreover, the antenna 108 is preferably a one-quarter wavelength antenna, and therefore preferably has a length of approximately 4 inches at the preferred range of frequencies.

Figure 3:
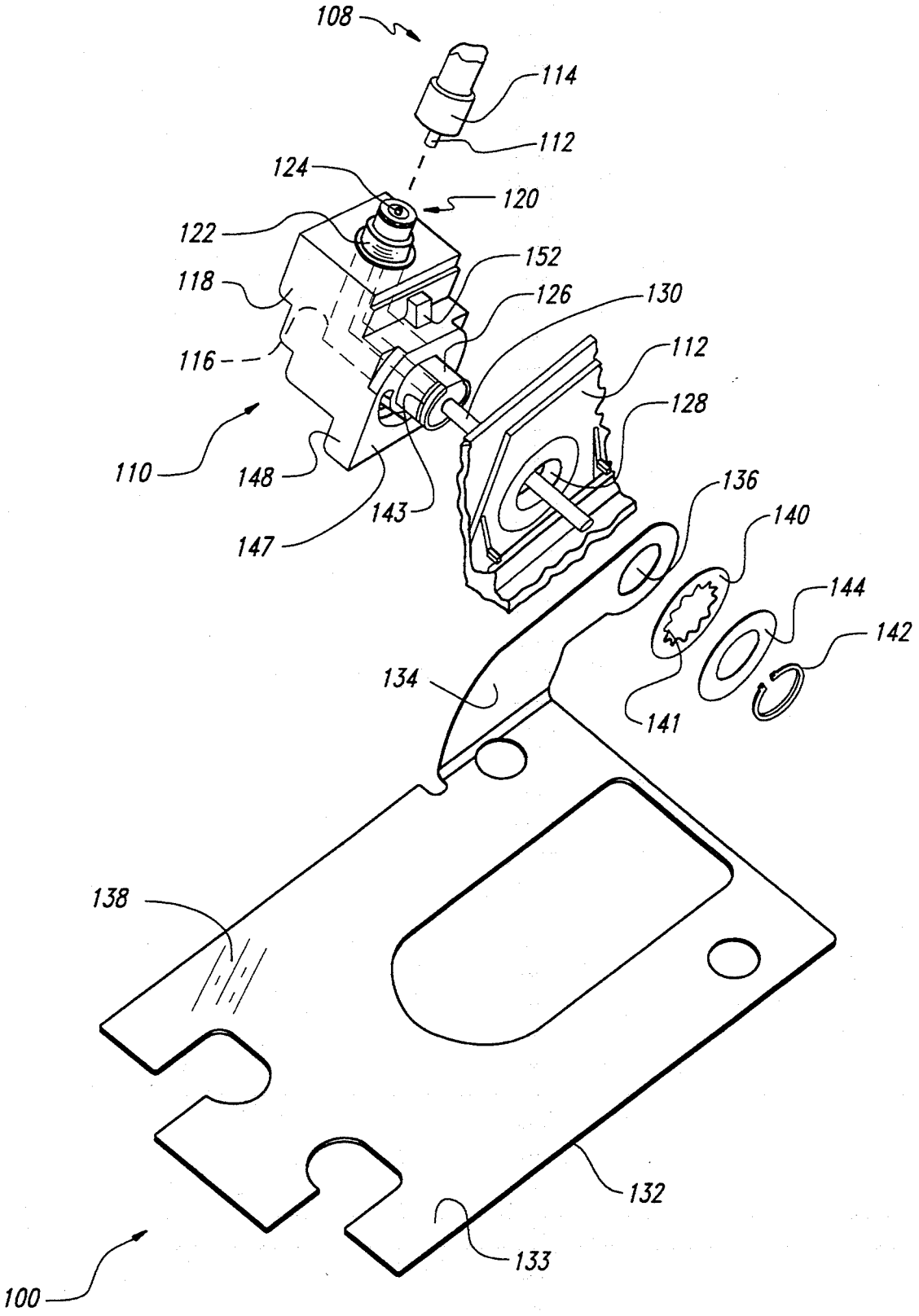
FIG. 3 is an enlarged, fragmentary, exploded isometric right side isometric view of the antenna assembly of FIG. 1.

As shown in FIG. 3, the antenna 108 has an elongated center conductor 115 extending along the length of and within the antenna 108, and a short interiorly threaded shield conductor 114 positioned coaxially about a lower end portion of the center conductor 115. An L-shaped coaxial connector 116 is positioned within an over-molded elastomeric member 118 forming the coupling member 110. The L-shaped coaxial connector 116 includes two coaxial electrical conductors: an outer conductor terminating as a threaded conductive connector 122 at a free end and as a ferrule or grooved conductive connector 126 at a pivoting end, and an inner conductor terminating as a central socket 124 at the free end and as a wire 130 at the pivoting end. The threaded conductive connector 122, threadably receives and is electrically coupled to the shield conductor 114, and the central socket 124 receives therein and is electrically coupled to the center conductor 115. The grooved conductive connector 126 extends through and is rotatably received within a hole 128 formed in the left wall 112 of the lower housing 104. The antenna connector 120 and the grooved conductive connector 126 protrude at right angles from the over-molded elastomeric member 118. The over-molded elastomeric member 118 is of sufficient size to provide a gripping surface to allow a user to manually grip and rotate the coupling member 110.

Figure 4:
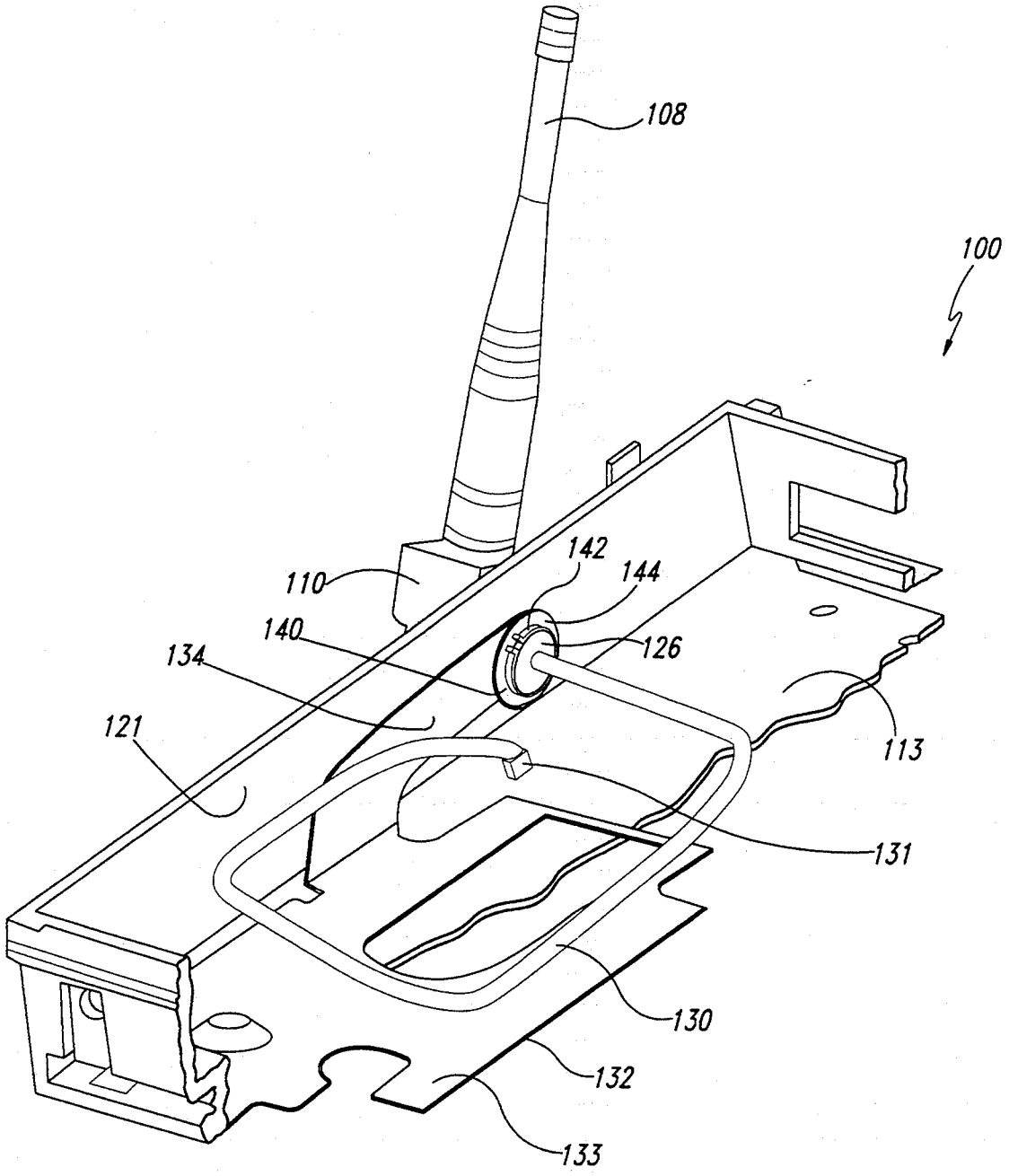
FIG. 4 is an enlarged scale, isometric, fragmentary, right side isometric view of the antenna assembly of FIG. 1.

The wire 130, electrically coupled to the central socket 124, extends coaxially from the grooved conductive connector 126 through the hole 128. The wire 130 extends a substantial distance within the device 100, preferably making an extended loop within the device 100 as shown in FIG. 4, before connecting to the communications circuitry therein by a connector 131. The wire 130 is of sufficient length to withstand repeated coaxial rotations of up to 180° as the antenna 108 and the L-shaped connector 116 are rotated, as will be described below, without breaking, despite its brittle composition.

An approximately planar ground plane 132, positioned within and about the bottom side 113 of the lower housing 104, includes a base portion 133 and a left side portion 134 extending upward from the left side of the base portion 133 at the left wall 112 of the device, approximately perpendicular to the bottom wall 113. A hole 136 formed in the left side portion 134 is coaxially aligned with the hole 128 formed in the left side 112 of the lower housing 104. The ground plane 132 is fabricated of an electrically conductive material, such as copper. A dielectric material or plastic film 138, preferably Mylar®, manufactured by DuPont Corporation, covers both sides of the base portion 133 and the left side portion 134 of the ground plane 132.

A toothed washer 140 of an electrically conductive material is coaxially disposed on the portion of the grooved conductive connector 126 extending through the hole 136 of the left side portion 134 and into the interior of the device 100. The toothed washer 140 has a fiat face which rests against the inner surface of the left side portion 134. The toothed washer 140 has teeth 14 1 about its inner circumference. The teeth 14 1 project radially inward a sufficient amount to ensure that the teeth contact and electrically couple to the grooved conductive connector 126. A C-shaped snap ring 142 is coaxially received on the grooved conductive connector 126, and is received within a circumferential groove 143 formed toward the end of the grooved connective connector. The snap ring 142 rotatably retains the coupling member 110 to the left wall 112 of the lower housing 104. A spring washer 144 is coaxially received on the grooved conductive connector 126, between the toothed washer 140 and the snap ring 142. The spring washer 144 resiliently biases the elastomeric member 118 of the coupling member 110 into engagement with the left wall 112 of the lower housing 104 to reduce wobbling of the antenna 108. The coupling member 110, the toothed washer 140, the snap ring 142, and the spring washer 144 together form a rotation assembly which permits the antenna 108 to rotate with respect to the lower housing 104.

As best seen in FIG. 2, the left side wall 112 of the lower housing 104 has several concentric seal tings 146 formed therein about the hole 128, and extending outward. The elastomeric member 118 is preferably made of a resilient, elastic material such as an elastomer. The spring washer 144 biases a right end surface 147 (see FIG. 5) of the elastomeric member 118 tightly against the concentric seal rings 146 to form an environmental seal between the coupling member 110 and the left side wall 112 to prevent entry of contaminants through the hole 128 and into the interior of the device 100. The concentric seal rings 146 seal the hole 128 but yet permit the coupling member 110 to rotate relative to the lower housing 104 about an axis of rotation coaxially aligned with the hole 128.

The coupling member 110 can be rotated relative to the lower housing 104 between an upright position wherein the antenna 108 is approximately vertical with respect to the base portion 133 of the ground plane 132 (as shown in FIG. 1), and a stowed position wherein the antenna is rotated rearward so as to be approximately aligned with the elongated left side wall 112, as shown in FIG. 1 in phantom line. Rotation of the coupling member 110 upward beyond the upright position is prevented by a lower rear portion 148 of the elastomeric member 118 which contacts a first stop 150 formed on the left side wall 112 of the lower housing 104 (shown in FIG. 2) when the antenna 108 reaches the upright position. As best shown in FIG. 3, rotation of the coupling member 110 rearward beyond the stowed position is prevented by a second stop 152 formed as a part of the elastomeric member 118, above the right end surface 147 of the elastomeric member, which contacts the upper end of the first stop 150 when the antenna 108 reaches the stowed position. The coupling member 110, and thus the antenna 108, preferably rotate approximately 120° from the stowed position to the upright position.

In the stowed position, the antenna 108 does not protrude awkwardly above the device 100. Ergonomically, the stowed position for the antenna 108 allows the device 100 to be received and carried within a holster (not shown) or other carrying device. In the stowed position, the antenna 108 is nestled against the left side wall 112 of the housing 104, reducing the possibility of the antenna becoming entangled with the user or obstacles in the surrounding work environment as the device is being transported by the user. When the device 100 is in use, the antenna 108 is preferably rotated in the upright position, because a stationary antenna (not shown) which receives data from or transmits data to the device is likely oriented vertically, thus giving the device the most effective communications range since the two antennae will be similarly aligned. Additionally, although not required, when the antenna 108 is in the upright position, the antenna is approximately perpendicular to the base portion 133 of the ground plane 132, providing improved transmission/reception performance for the device 100.

As the coupling member 110 and its grooved conductive connector 126 rotate, the toothed washer 140 with its teeth 141 grasping the grooved conductive connector, will similarly rotate, and its flat face slides against the plastic film 138 covering the surface of the left side portion 134 of the ground plane 132 which remains stationary. The plastic film 138 coating the ground plane 132 about the hole 136 provides a sufficiently lower coefficient of friction to substantially decrease wear between the fiat face of the toothed washer 140 and the ground plane 132, avoiding metal-on-metal frictional contact. It is noted that the snap ring 142 and the spring 144 similarly rotate with the coupling member 110.

The toothed washer 140 is electrically coupled to the shield conductor 114 of the antenna 108 through the grooved conductive connector 126 and the threaded conductive connector 122, and the biasing force applied by the spring washer 144 holds the toothed washer 140 in face-to-face juxtaposition with the left side portion 134 of the ground plane 132. As a result, the toothed washer 140 forms one plate of a parallel plate capacitor, with the left side portion 134 of the ground plane 132 about the hole 128 forming the other parallel plate, with the plastic film 138 positioned therebetween forming a dielectric. The shield conductor 114 of the antenna 108 is thereby capacitively coupled to the ground plane 132. Since the device 100 communicates at high frequencies, this capacitive coupling substantially forms a short circuit between the shield conductor 114 of the antenna 108 and the ground plane 132, essentially directly electrically coupling the shield conductor to the ground plane.

The toothed washer 140 is preferably a substantially flat-faced ring. Consequently, the value of the capacitance formed between the toothed washer 140 and the ground plane 132 is estimated by the following equation:

$$\text{Capacitance} = \frac{\epsilon\pi(R_1 - R_2)^2}{d}$$

where equals the dielectric constant of the plastic film 138, $R_1$ is the outer radius of the toothed washer 140, $R_2$ is the average inner radius of the toothed washer 140, and d is the distance between the left side portion 134 of the ground plane 132 and the toothed washer 140 (i.e., the thickness of the plastic film 138). The size of the toothed washer 140 and the thickness and composition of the plastic film 138 are preferably selected to provide a capacitance of between 10 and 15 picofarads (pF). Below 10 pF, the antenna 108 does not sufficiently electrically couple to the ground plane 132 at the preferred communication frequency. The spring washer 144 ensures that the toothed washer 140 and the left side portion 134 are approximately parallel even as the toothed washer rotates, thus the capacitance does not vary as the toothed washer rotates with the coupling member 110.

Mylar is the preferred plastic film 138 coveting the ground plane 132 because Mylar is relatively inexpensive and easy to apply to the ground plane during manufacture. Additionally, Mylar provides an acceptably low coefficient of friction and an acceptable dielectric constant. The size and geometry of the ground plane 132 may be adjusted to provide appropriate tuning for the antenna 108 and the device 100, as is known by those skilled in the art.

The present invention allows the quarter wavelength antenna 108 to be rotatably coupled to the electronic device 100. The present invention provides a long life rotatable coupling between the antenna 108 and the device 100 by eliminating metal-on-metal contact between parts that rotate relative to each other, while still electrically coupling the antenna to the ground plane 132. The coupling member 110 rotatably connects the antenna 108 to the lower housing 104 and electrically couples the antenna to the toothed washer 140.

The elastomeric member 118, when biased against the concentric seal rings 146 of the left side wall 112 of the lower housing 104, provides an environmental seal between the elastomeric member and the exterior of the device 100 about the hole 128. Overall, the antenna 100 is capacitively coupled to the ground plane 132 using a long life and environmentally sealed connection which will not deteriorate after repeated rotations of the antenna. The antenna may be repeatedly rotated with respect to the lower housing 104 without damage to the device 100, disconnection of the antenna from the ground plane 132, or degradation of the environmental integrity of the device about the hole 128.

Although a specific embodiment of the invention has been described for purposes of illustration, various modifications may be made without departing from the spirit and scope of the invention. Accordingly, the invention is not limited by the disclosure, but instead its scope is to be determined entirely by reference to the following claims.

We claim:

1. An antenna assembly for a hand-held device for transmitting or receiving signals, comprising:

a housing of a rigid material having a hole formed therein;

an elongated, one-quarter wavelength antenna having first and second antenna conductors;

a rotatable coupling member having a first end portion rigidly retaining the elongated antenna and having a second end portion rotatably received by the housing and extending through the hole to within the housing and retained in the hole for rotation relative to the housing, the coupling member and the antenna being rotatable as a unit between a first position where the antenna is in a raised position with respect to the housing and a second position where the antenna is in a lowered position, the coupling member having first and second coupling conductors extending between the first and second end portions, the first and second coupling conductors being electrically coupled to the first and second antenna conductors, respectively, at the first end portion;

an electrically conductive ground plane positioned within the housing, the ground plane having a non-planar portion being at least partially covered on one side thereof with a non-conductive material, the covered portion of the ground plane having an aperture aligned with the hole and receiving the second end portion of the coupling member therethrough; and an electrically conductive plate positioned within the housing and electrically coupled to the second coupling conductor at the second end portion of the coupling member, the plate having a first face thereof positioned approximately parallel to the covered portion of the ground plane with the non-conductive material positioned therebetween, the plate being capacitively coupled to the ground plane upon the transmission or reception of signals by the antenna.

2. The antenna assembly of claim 1 wherein the first and second antenna conductors are coaxial, the first and second coupling conductors are coaxial, the coupling member is approximately L-shaped, and the plate is a washer coaxially received about the second coupling conductor at the second end portion of the coupling member, and wherein the first face of the washer is in rotational engagement against the covered portion of the ground plane as the antenna is rotated between the raised and lowered positions.

3. The antenna assembly of claim 2, further comprising a spring and a locking member, the spring being positioned coaxial with the second end portion of the coupling member and adjacent to a second face of the plate, the locking member being positioned adjacent to the spring and retaining the second end portion of the coupling member within the housing against withdrawal from the hole.

4. The antenna assembly of claim 2 wherein the coupling member includes an elastomeric gripping portion coveting the first and second conductors between the first and second end portions, and has an engagement face from which the second end portion protrudes, wherein the housing includes at least one seal ring at an exterior surface of the housing and extending about the hole, the engagement face being received against and rotatable relative to the seal ring to substantially form an environmental seal therebetween as the antenna is rotated between the raised and lowered positions.

5. The antenna assembly of claim 1 wherein the non-conductive material and the plate are chosen to provide a capacitance of greater than ten picofarads between the plate and the ground plane.

6. The antenna assembly of claim 1 wherein the elongated antenna is approximately perpendicular to the ground plane in the raised position, and wherein the elongated antenna is adjacent to the housing in the lowered position.

7. An antenna assembly for a hand-held device for transmitting or receiving signals, comprising:

a housing having a hole formed therein;

an elongated antenna having first and second antenna conductors;

a rotatable coupling member having a first end portion rigidly retaining the elongated antenna and having a second end portion rotatably received by the housing and extending through the hole and retained therein for rotation relative to the housing, the coupling member and the antenna being rotatable as a unit between a first position where the antenna is in an approximately upright position with respect to the housing and a second position where the antenna is in a non-upright position, the coupling member having first and second coupling conductors extending between the first and second end portions, the first and second coupling conductors being electrically coupled to the first and second antenna conductors, respectively, at the first end portion;

an electrically conductive ground plane positioned adjacent to the housing, the ground plane being at least partially covered on one side thereof with a non-conductive material; and an electrically conductive plate positioned within the housing and electrically coupled to the second coupling conductor at the second end portion of the coupling member, the plate having a first face thereof positioned approximately parallel to a portion of the ground plane covered with the non-conductive material, the plate being capacitively coupled to the ground plane upon the transmission or reception of signals by the antenna.

8. The antenna assembly of claim 7 wherein the first and second antenna conductors are coaxial, the first and second coupling conductors are coaxial, the second end portion extends through an aperture formed in the covered portion of the ground plane, and the plate is a washer coaxially received about the second coupling conductor at the second end portion of the coupling member and wherein the first face of the washer is in rotational engagement against the covered portion of the ground plane as the antenna is rotated between the upright and non-upright positions.

9. The antenna assembly of claim 8, further comprising a spring and a locking member, the spring being positioned coaxial with the second end portion of the coupling member and adjacent to a second face of the plate, the locking member being positioned adjacent to the spring and fixedly retaining the second end portion of the coupling member within the housing.

10. The antenna assembly of claim 8 wherein the washer includes a plurality of teeth projecting inwardly, the teeth contacting and electrically coupling the washer to the second coupling conductor.

11. The antenna assembly of claim 10 wherein the washer rotates against the non-conductive material as the antenna is rotated, and wherein the non-conductive material has a coefficient of friction between the non-conductive material and the washer that is lower than a coefficient of friction between the washer and the ground plane.

12. The antenna assembly of claim 7 wherein the coupling member includes an elastomeric member covering the first and second conductors, between the first and second portions, and has an engagement face from which the second end portion protrudes, wherein the housing includes at least one seal ring at an exterior surface of the housing and extending about the hole, the engagement face being received against and rotatable relative to the seal ring to substantially form an environmental seal therebetween as the antenna is rotated between the upright and non-upright positions.

13. An antenna assembly for a hand-held device having a housing, comprising:

an elongated antenna having a first antenna conductors;

a rotatable coupling member having a first end portion rigidly retaining the elongated antenna and having a second end portion rotatably received by the housing and extending into the housing, the coupling member and the rotatable as a unit between a first position and a second position, the coupling member having first and second coupling conductors extending between the first and end portions, respectively, the first and second coupling conductors being electrically coupled to the first and second antenna conductors respectively;

an electrically conductive ground plane;

an electrically conductive plate electrically coupled to the second coupling conductor and having a first face positioned adjacent to at least a portion of the ground plane;

a non-conductive material positioned between the portion of the ground plane and the first face of the plate, the plate being capacitively coupled to the ground plane through the non-conductive material.

14. The antenna assembly of claim 13 wherein the antenna is in an approximately upright position with respect to the housing in the first position, and approximately adjacent to the housing in the second position.

15. The antenna assembly of claim 13 wherein the plate and at least the portion of ground plane are positioned within the housing and the first face of the plate is positioned approximately parallel to the portion of the ground plane.

16. The antenna assembly of claim 13 wherein the first and second antenna conductors are coaxial, the first and second coupling conductors are coaxial, the coupling members are approximately L-shaped, and the plate is an annular plate coaxially received about the second end portion of the coupling conductor, and wherein the portion of the ground plane has an aperture aligned with a hole in the housing to receive a second end portion of the coupling member therethrough.

17. The antenna assembly of claim 16, further comprising a spring and a locking member, the spring being positioned coaxial with the second end portion of the coupling member and adjacent to a second face of the plate, the locking member being positioned adjacent to the spring and retaining the second end portion of the coupling member relative to the housing.

18. The antenna assembly of claim 16 wherein the washer includes a plurality of teeth projecting inwardly, the teeth contacting and electrically coupling the washer to the second coupling conductor, and wherein the washer rotates against the non-conductive material as the antenna is rotated.

19. The antenna assembly of claim 18 wherein the non-conductive material has a coefficient of friction between the non-conductive material and the washer that is lower than a coefficient of friction between the washer and the ground plane.

20. The antenna assembly of claim 13 wherein the composition of the non-conductive material and the size of the plate are chosen to provide a capacitance of greater than 10 picofarads between the plate and the ground plane.

21. The antenna assembly of claim 13 wherein the non-conductive material is a plastic film formed on at least a portion of one of the plate and the portion of the ground plane.

* * * * *

UNITED STATES PATENT AND TRADEMARK OFFICE

CERTIFICATE OF CORRECTION

PATENT NO. : 5,440,315
DATED : August 8, 1995
INVENTOR(S) : George C. Wright, David W. Gilpin and Stanley W. Jones It is certified that error appears in the above-indentified patent and that said Letters Patent is hereby corrected as shown below:

On the cover page, item [75], after "David W. Gilpin, Everett;" please delete "Stanley W. Jones, deceased, late of Lopez, all of Wash.; by Ivaly J.; Hoedemaker, administratrix" and substitute therefor -- Stanley W. Jones, deceased, late of Lopez, by Ivaly J. Hoedemaker, administratrix; all of Wash. --.

In column 8, claim 4, line 16, please delete "coveting" and substitute therefor -- covering --.

In column 9, claim 13, line 43, after "having", please delete "a first antenna" and substitute therefor -- first and second antenna --.

In column 9, claim 13, line 49, after "and the", please insert -- antenna being --.

In column 9, claim 13, line 52, after "first and", please insert -- second --.

Signed and Sealed this

Nineteenth Day of March, 1996

Bruce Lehman

*Attest:*

BRUCE LEHMAN

*Attesting Officer*

*Commissioner of Patents and Trademarks*